US006786372B2

(12) United States Patent
Enkerlin et al.

(10) Patent No.: US 6,786,372 B2
(45) Date of Patent: Sep. 7, 2004

(54) BELT CLIP APPARATUS FOR PORTABLE ELECTRONIC DEVICE

(75) Inventors: E. Michael Enkerlin, Poway, CA (US); Ron L. Lawrence, San Diego, CA (US)

(73) Assignee: Clip Technology, Inc., San Diego, CA (US)

( * ) Notice: Subject to any disclaimer, the term of this patent is extended or adjusted under 35 U.S.C. 154(b) by 233 days.

(21) Appl. No.: 09/948,963

(22) Filed: Sep. 7, 2001

(65) Prior Publication Data

US 2003/0047575 A1 Mar. 13, 2003

(51) Int. Cl.[7] ..... A45F 5/00; A01K 97/06

(52) U.S. Cl. ..... 224/271; 224/196; 224/197; 224/930; 455/100

(58) Field of Search ..... 224/196, 197, 224/291, 272, 269, 930; 24/573.11, 3.11; 455/100

(56) References Cited

U.S. PATENT DOCUMENTS

| | | | | |
|---|---|---|---|---|
| 4,419,794 A | | 12/1983 | Horton, Jr. et al. | |
| 4,718,586 A | | 1/1988 | Hagino | |
| 5,274,885 A | | 1/1994 | Hellweg | |
| 5,347,693 A | * | 9/1994 | Otrusina | 24/573.11 |
| 5,584,423 A | | 12/1996 | Wang | |
| 5,597,102 A | | 1/1997 | Saarikko et al. | |
| 5,620,120 A | * | 4/1997 | Tien | 224/272 |
| 5,730,342 A | | 3/1998 | Tien | |
| 5,779,115 A | | 7/1998 | Parkas et al. | |
| 5,839,173 A | | 11/1998 | Otrusina | |
| 5,850,954 A | | 12/1998 | Dong-Joo | |
| 5,850,996 A | | 12/1998 | Liang | |
| 5,996,184 A | | 12/1999 | Mah et al. | |
| 6,006,969 A | | 12/1999 | Kim | |
| 6,032,337 A | | 3/2000 | Rankin, Jr. et al. | |
| 6,038,742 A | | 3/2000 | Patterson | |
| 6,098,858 A | | 8/2000 | Laugesen | |
| 6,125,513 A | | 10/2000 | Cheraso et al. | |
| 6,206,257 B1 | | 3/2001 | Peele et al. | |
| 6,233,788 B1 | | 5/2001 | Choy et al. | |
| 6,283,348 B1 | * | 9/2001 | Wang | 224/271 |

* cited by examiner

*Primary Examiner*—Nathan J. Newhouse
(74) *Attorney, Agent, or Firm*—Gordon & Rees LLP

(57) ABSTRACT

A belt clip apparatus for releasably holding a portable device on a user's apparel has a base member with a latch opening for receiving a lock pin projecting from the portable device, a clip for securing the base member to the wearer's apparel, and a latch member movably mounted in the base member for movement between a first position locking the lock pin in the latch opening, and a released position permitting the lock pin to be removed from the latch opening. A manually operable actuator linked to the latch member can be actuated by a user to move the latch member between the locked and released positions. The actuator is moved in a generally horizontal direction transverse to the hanging direction in order to release the latch member. A biasing device biases the latch member towards the locked position.

26 Claims, 4 Drawing Sheets

BELT CLIP APPARATUS FOR PORTABLE ELECTRONIC DEVICE

BACKGROUND OF THE INVENTION

The present invention relates generally to a belt clip apparatus designed to support a portable device such as a cell phone, handheld PC's, pager, or the like, on a wearer's belt, waistband, or other part of the clothing such as a pocket, so that the device is readily accessible for use while not interfering with the wearer's normal activities when not in use.

Belt clip devices are commonly used to allow a user to carry a communication device without needing to hand carry such devices or carry them in a pocket, bag, purse or briefcase, where it may be difficult to hear a signal from the communication device, and where the device may potentially be damaged or not readily accessible for use. A belt clip device generally has a base or holder for releasable attachment to the communication device or other portable device, and a clip hinged to the base and spring loaded towards the base for engagement over a wearer's belt or the like in order to attach the device to the belt. In some cases, the base is of a holster type for receiving a major portion of the communication device. In other cases, the base and housing of the communication device have interengageable latching formations to allow the communication device to be releasably secured to the base. For example, in U.S. Pat. No. 5,779,115 of Parkas et al., a support stud on the mobile phone is received in guide grooves on the belt clip. A locking tongue is spring loaded into a locking position holding the stud in the grooves. A sliding actuator is pushed down in order to move the tongue into a release position so that the stud may be removed from the belt clip. U.S. Pat. No. 6,098,858 of Langesen shows another belt clip with a holder for carrying a cell phone or the like, with a latch released by a push button.

Other belt clip devices operate in a similar manner, with the latch or locking member generally being released by means of a push button or the like on the belt clip device. However, there is a risk that such push button actuators may be accidentally actuated due to normal movement of the user, such as bending, running, or the like, resulting in potential loss or damage of the electronic device. Additionally, the latch mechanism may be damaged or break as a result of repeated use. Also, these devices generally comprise a relatively large number of separate parts, adding to complexity and expense, and increasing the risk of failure or jamming of the device.

U.S. Pat. No. 6,206,257 of Peele et al. illustrates a different belt clip device in which a button on the rear of a portable communication device is adapted to slide laterally into a horizontal channel on the clip device, and is then held in position by a spring loaded locking tab engaging a latch opening in the button. The locking tab is released by user engageable release tabs on each side of the channel, which must be squeezed inwardly in order to retract the locking tab. This is a relatively awkward and cumbersome release mechanism.

SUMMARY OF THE INVENTION

It is an object of the present invention to provide a new and improved belt clip apparatus for a portable device such as a portable communication device.

According to the present invention, a belt clip apparatus is provided which comprises a clip member for attachment to a user's apparel in a generally vertical orientation, the clip member having a latch opening, and a hanger or anchor member for securing to a portable device to be suspended vertically from the clip member, the hanger member having a lock pin for engagement in the latch opening, the clip member further comprising a latch member movable between a first position locking the lock pin in the latch opening, and a released position permitting the lock pin to be removed from the latch opening, and a manually operable actuator linked to the latch member for moving the latch member between the locked and released positions, the actuator being adapted to be moved in a generally horizontal direction transverse to the hanging direction in order to release the latch member.

Since the actuator is moved laterally or sideways in order to release the latch member and allow the lock pin to be removed from the latch opening, there is less risk of the portable device being released accidentally, since a sideways movement of an actuator would be unlikely to occur accidentally, unlike a push down movement.

In an exemplary embodiment of the invention, the clip member has a first part or base member, a second part or clip hinged to the first member, and a biasing device for biasing the second part against the first part so as to hold the belt clip apparatus on a wearer's clothing or belt with the first part on one side and the second part on the other side of the belt or clothing with a portion of the belt or clothing gripped between them. The first part has the latch opening for receiving the lock pin projecting from a rear face of an object to be releasably secured to the first part, and the latch member movably mounted on the first part for movement between the locking and released positions. The latch opening comprises an elongate opening having a larger first end portion, a second end portion of smaller dimensions than the first end portion, and a longitudinal axis which extends in a generally vertical direction when the apparatus is in use, the lock pin being retained in the smaller, second end portion of the latch opening when the latch member is in the first position and being movable into the larger, first end portion when the latch member is in the second position. The actuator is linked to the latch member for moving the latch member from the first position to the second position, the latch member and actuator being movably mounted on the first part for movement in a path generally transverse to the longitudinal axis of the latch opening from the first position to the second position, the latch member having a latching tab protruding at least partially across the slot in the first position and being retracted away from the slot in the second position.

In an exemplary embodiment, the latch member is biased from the second position back to the first position, such that it springs back into the latching position when the actuator is released. The latch member and actuator may be formed integrally and rotatably mounted on the first member for rotation about a pivot axis between the first and second positions. The latch member may also include an integral spring finger for providing the biasing force urging the latch member back to the first, latching position.

In one exemplary embodiment of the invention, the first part of the belt clip apparatus comprises a housing having spaced side walls and end walls, a front wall and a rear wall, and the latch slot is provided in the front wall of the housing. The latch member and actuator are formed as a one piece latch actuator which is rotatably mounted in the housing for rotation about a pivot axis extending transverse to the front and rear walls, the pivot axis being located adjacent the larger end portion of the slot. One end wall of the housing has an opening through which a finger actuator portion of the latch actuator protrudes, and the protruding actuator portion may be enlarged to form a gripping region for easier actuation by a user. The opening is of larger dimensions than the enlarged actuator portion, to allow the actuator portion to be pushed sideways from one side of the opening to the other, simultaneously moving the latch member from the first to the second position.

The latch actuator is shaped to follow the contour of the slot between the actuator portion and the latch member, and the latching tab is shaped to protrude across the smaller end portion of the slot when in the first position. An integral spring finger may project from the actuator towards one side wall of the housing, or may have an end secured to a wall of the housing, so that it is resiliently deformed by engagement with the wall of the housing when the latch member is moved from the first position to the second position. The spring finger will therefore act to bias the latch member back towards the first position when the actuator portion is released by the user.

The latch arrangement of this invention is more secure than prior, push down release latch mechanisms, which were subject to accidental release in some circumstances. The user must push the actuator portion sideways with their thumb or fingers in order to release the latch, and this is a movement which will not readily happen accidentally, unlike a simple push down movement. The combined latch actuator is also of relatively simple construction and avoids the need for multiple different parts, and the resultant potential for failure.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
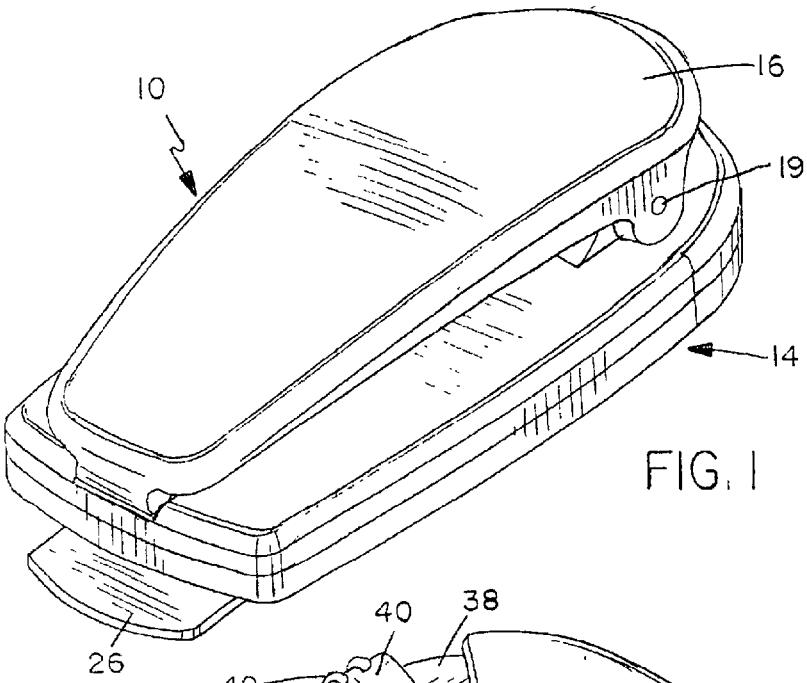
FIG. 1 is a rear perspective view of the belt clip apparatus according to an exemplary embodiment of the invention.
Figure 2:
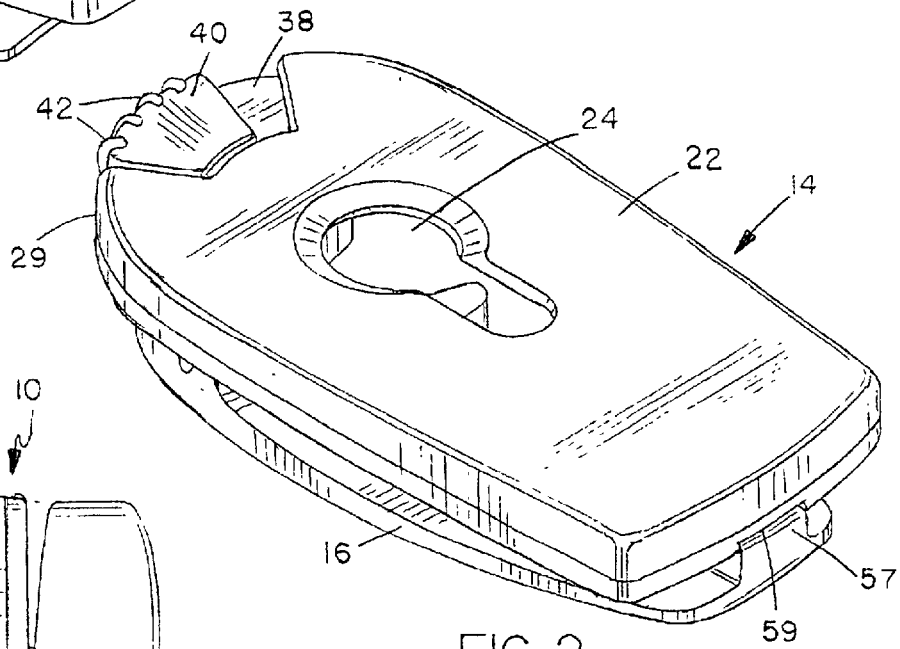
FIG. 2 is a front perspective view thereof, with the detachable carrier plate removed.
Figure 3:
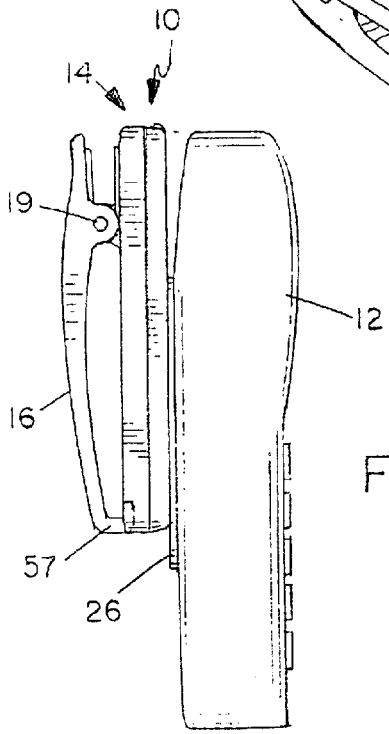
FIG. 3 is a side view showing a typical cell phone mounted on the carrier plate.
Figure 4:
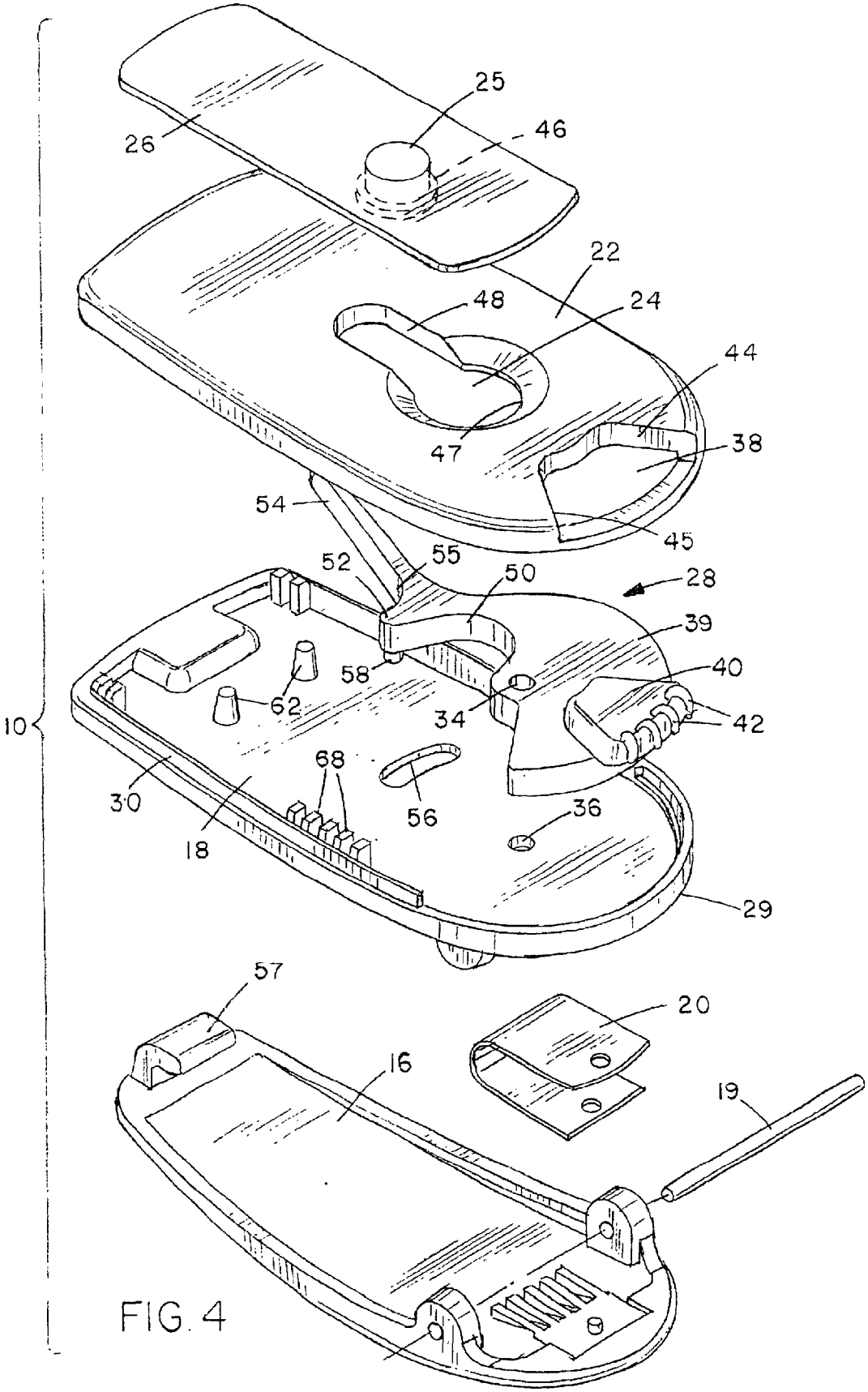
FIG. 4 is an exploded perspective view showing the components of the unit.
Figure 5:
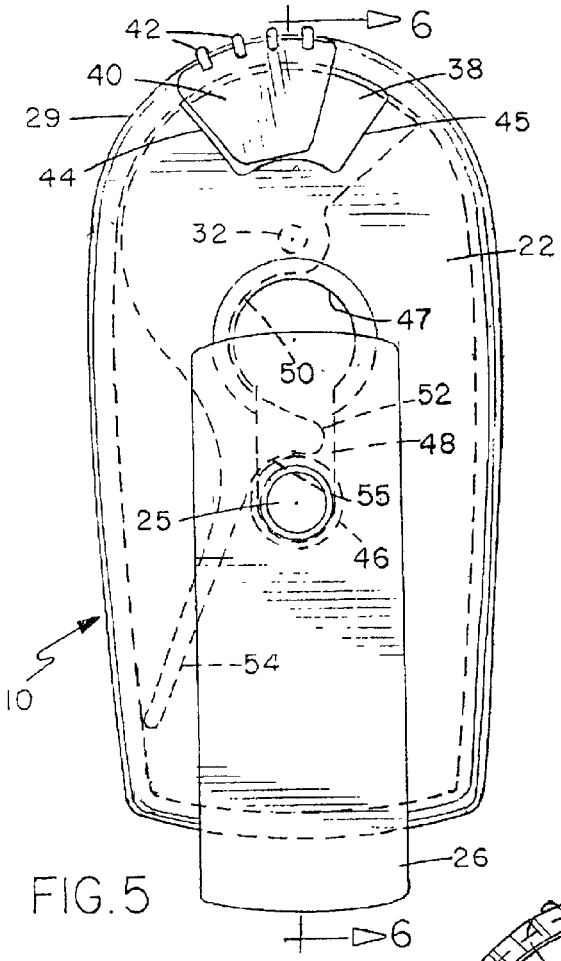
FIG. 5 is a front view of the unit.
Figure 6:
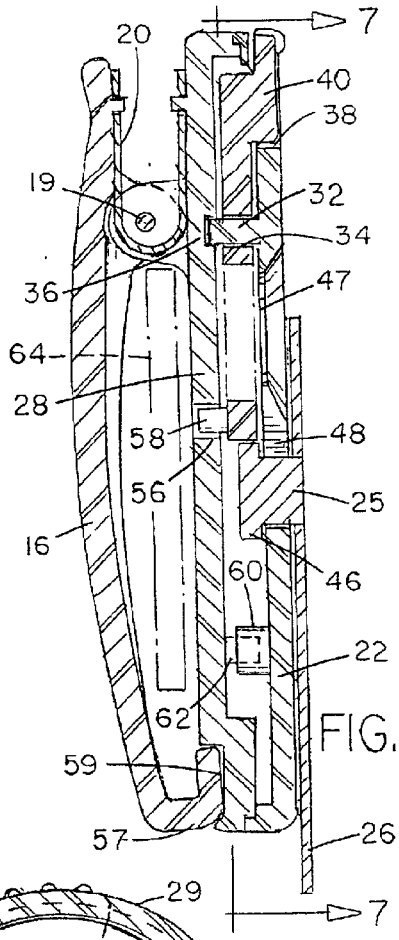
FIG. 6 is a sectional view taken on line 6—6 of FIG. 5.

FIGS. 1 to 7 of the drawings illustrate a belt clip apparatus 10 according to an exemplary embodiment of the invention for releasably securing a portable device 12 such as a cell phone, pager, personal organizer and handheld PC's, two way radio, or the like to a wearer's belt, waistband, or other part of the wearer's clothing. The apparatus 10 basically comprises a first member or base housing 14 and a belt clip 16 hinged at one end to a rear wall 18 of the housing via axle 19 and biased into a position against the rear wall by a leaf spring 20 or equivalent. The clip 16 has a hook 57 at its lower end which engages in a corresponding notch 59 in an end wall of the housing when closed, as indicated in FIGS. 2, 3 and 6. The housing 14 has a front wall 22 with a latch slot 24 designed to receive a latch pin 25 protruding from an anchor plate 26 which is secured to the rear wall of device 12, and a latch member 28 is rotatably mounted in the housing and arranged to releasably secure the latch pin 25 in the slot, as explained in more detail below.

In one example, the base housing and clip member are molded of a suitable plastic material, such as ABS plastic or polyvinyl chloride (PVC), while the latch member 28 is molded of a different type of plastic material, such as acetal material, to give resiliency and self-lubricating rotational ability of the latch member 28 relative to the housing. The anchor plate may be a stamped metal plate, or may also be made of plastic material. The two part base housing has front and rear walls of generally rectangular shape with a rounded upper end 29, each wall having a raised peripheral rim 30 which is secured to the rim of the opposing wall in any suitable manner, such as sonic or solvent welding, snap lock engagement, or adhesive. The front and rear walls are secured together with the latch member 28 rotatably engaged in the resultant internal cavity, via a pivot pin 32 extending from the rear wall through a pivot opening 34 in the latch member 18, and then into a retaining bore 36 in the inner face of the front wall, as best illustrated in FIGS. 4 and 6.

A generally arcuate, sector-shaped cut out 38 is formed at the curved upper end 29 of the front wall 22. The latch member 28 has a part circular upper portion 39 on which the pivot opening 34 is centered. A thickened, actuator portion 40 of similar shape to that of the cut-out 38 is provided at the upper end of the part-circular portion 39. Portion 40 is of smaller dimensions and smaller angular width than cut-out 38, and is positioned such that, when the front and rear walls are secured together with the latch member rotatably trapped between them, the actuator portion 40 is located in the cut-out 38. Actuator portion has raised ribs or grip formations 42 around its upper end. A user can therefore move the actuator portion 40 sideways between opposite end walls 44,45 of the cut-out 38, rotating the latch member 28 about pivot pin 32, while the end walls 44 and 45 restrict the amount of rotation of the latch member 28 and define opposite end positions of the latch member.

As best illustrated in FIG. 6, the latch pin 25 has an enlarged annular rim 46 at its lower end. The latch slot has an enlarged, round upper end portion 47 which is of large enough diameter to receive the enlarged lower rim 46 of the pin 25, and a narrower, straight lower end portion 48. The latch pin 25 is pushed down into the lower end portion 48 of the slot in order to hold the latch pin in the housing. The latch member 28 has an arcuate cut-out or indent 50 adjacent the pivot opening 34, as best illustrated in FIG. 4. The lower end of the cut-out 50 is extended inwardly to form a latch tab or finger 52. When the latch member 28 is positioned in the first, latching position of FIG. 5, the latch finger 52 projects across part of the slot 24 at a location adjacent the junction between the upper end portion 47 and the lower end portion 48, preventing the latch pin from moving upwardly to the larger end of the latch slot. In this position, the actuator portion 40 of the latch member is positioned adjacent the left hand end 44 of the housing cut-out. By sliding the actuator portion sideways to the right hand end 45 of the cut-out, the latch device is rotated in a clockwise direction from the latched position to the second, released position of FIG. 7.

The latch member 28 also has an integrally formed, elongate, spring finger 54 projecting from the lower side of latch finger 52 towards one side wall 30 of the housing. The latch member 28 has an arcuate notch 55 of predetermined shape and dimensions extending from the outer end of latch finger 52 up to the spring finger 54, which extends around the latch pin 25 as indicated in FIG. 5 when the pin is located in the latched position at the lower end of slot 48, with the latch member 28 in the latched position. The angular width of notch 55 exceeds 180°, such that any upward push on the portable device or cell phone 12 when held in the clip apparatus will result in an increased locking engagement between the pin and latch finger, and will not result in accidental release of the latch.

The dimensions of spring finger 54 are arranged such that, when the latch member is in the latched position of FIG. 5, the end of spring finger 54 is just touching the wall 30. When the latch device is rotated in the clockwise direction from this position, into the released position of FIG. 6, the spring finger is pressed against the wall 30 and resiliently deformed, applying biasing force to urge the latch device back towards the latched position. This reduces the risk of accidental release of the latch, and requires the operator to hold the actuator portion in the latch released position until a device has been released from the clip housing. When the latch member is moved to the released position, the latch finger 52 is moved to one side, away from the slot 24, allowing the latch pin 25 to be moved upwardly in the direction of the arrow in FIG. 7, until it enters the enlarged circular end 47, so that the enlarged end 46 can be pulled upwardly out of the slot.

As best illustrated in FIG. 4, the inner face of the rear wall 18 of the housing has an arcuate indent 56 which is aligned with the free end of the latch finger 52 and centered on the pivot axis 34. The latch finger has a guide pin 58 projecting from its free end into indent 56 with clearance. The guide pin 58 will travel along indent 56 as the latch member is moved back and forth between its latched and released positions. This provides increased strength and support for the latch finger, and further guiding and alignment of the latch member as it rotates. The guide pin engagement in the guide slot also reduces the risk of the latch finger being displaced or broken off accidentally if someone pulls upwardly on a device latched to the housing.

Figure 7:
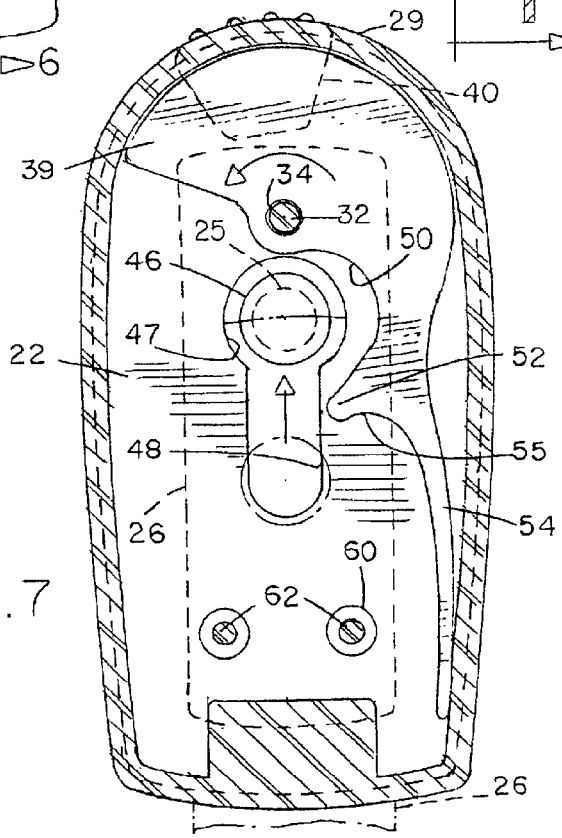
FIG. 7 is a sectional view taken on line 7—7 of FIG. 6, showing the latch in the released position.

The front wall 22 of the housing in the illustrated exemplary embodiment has a pair of spaced upstanding bosses 60 projecting from its inner face, and the rear wall has a correspondingly positioned pair of upstanding posts 62 for snap engagement in bores in the bosses 60, as indicated in FIGS. 4, 6, and 7, to add to the strength of the assembly. The bosses and posts are provided in the lower part of the housing, out of the path of rotational movement of the latch member 28. The front and rear walls of the housing, the belt clip member 16, and the latch member, are all designed for ease of manufacture by injection molding.

The belt clip apparatus is used by first engaging the clip over a user's belt 64 or other clothing, such as a waistband or the rim of a pocket, as indicated in FIG. 6. The clip 16 is pivoted away from the rear wall of the housing and then hooked over the belt 64, then released so that it springs back against the rear wall, with hook 57 engaging in notch 59, holding the apparatus on the belt with the housing 14 positioned in front of the belt and the latch slot 24 facing outwardly. The anchor plate 26 is secured to the rear wall of a portable device such as a cell phone 12. The owner of the device 12 engages latch pin 25 in the larger end 47 of the slot and pushes it down towards the lower end of the narrow portion 48 of the slot, with the pin 25 engaging arcuate portion 50 of the latch member 28, pushing the member 28 away and compressing spring 54. Once the pin 25 passes over finger 52, spring finger 54 forces the actuator member to rotate back until the actuator portion 40 engages the opposite end wall 44 of the cut out and the latch finger 52 protrudes across the slot, above the latch pin 25, to lock the latch pin in the slot. The portable device is then securely held by the belt clip apparatus and can be carried readily by the user until needed.

When the user wishes to release the portable device, for example in order to make or receive a call, they simply push the actuator portion 40 to one side again, until it reaches the end wall 45 of the cut-out and the latch finger moves away from the slot. The cell phone is then moved upwardly until the latch pin reaches the enlarged portion 47 of the slot, and then outwardly to release the latch pin from the slot. Since the latch is not released by a simple push button, there is considerably less risk of accidental release of the cell phone, for example when the user runs, bends over, or sits down. Instead of a push down motion, the user must slide the actuator portion or button to one side, and hold it in that position until the phone is pulled up and released. This action is much less likely to occur accidentally, but it is still relatively easy for the user to release the device when necessary, using only one hand.

At the same time, the belt clip apparatus is very simple and involves a minimum of parts. There are only five basic parts to the device, comprising the belt clip, belt clip housing front and rear walls, anchor plate, and the latch member. By making the belt clip housing walls and the latch member from different types of plastic having different melting points, it is possible to ultrasonically weld the front and rear walls together with the latch member rotatably mounted between them, without the latch member becoming welded to the housing walls and thus immovable. The plastic material of the latch member is designed to be self lubricating and resilient, to permit the spring member to be formed integrally with the latching and actuator portions. The housing wall thickness is relatively thin, to reduce mold cycle time and part cost, but incorporates strengthening ribs 68 to maintain the desired wall strength and durability. In an exemplary embodiment, the wall thickness varied from 0.060 to 0.090 inches.

Figure 8:
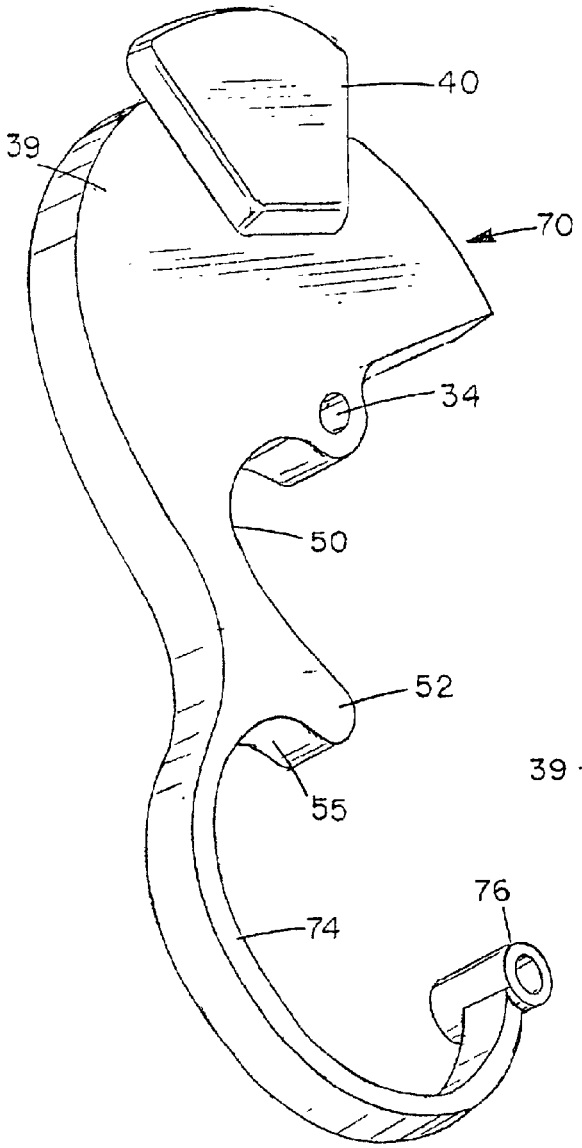
FIG. 8 is a front perspective view of a modified latch member for use in the apparatus.
Figure 9:
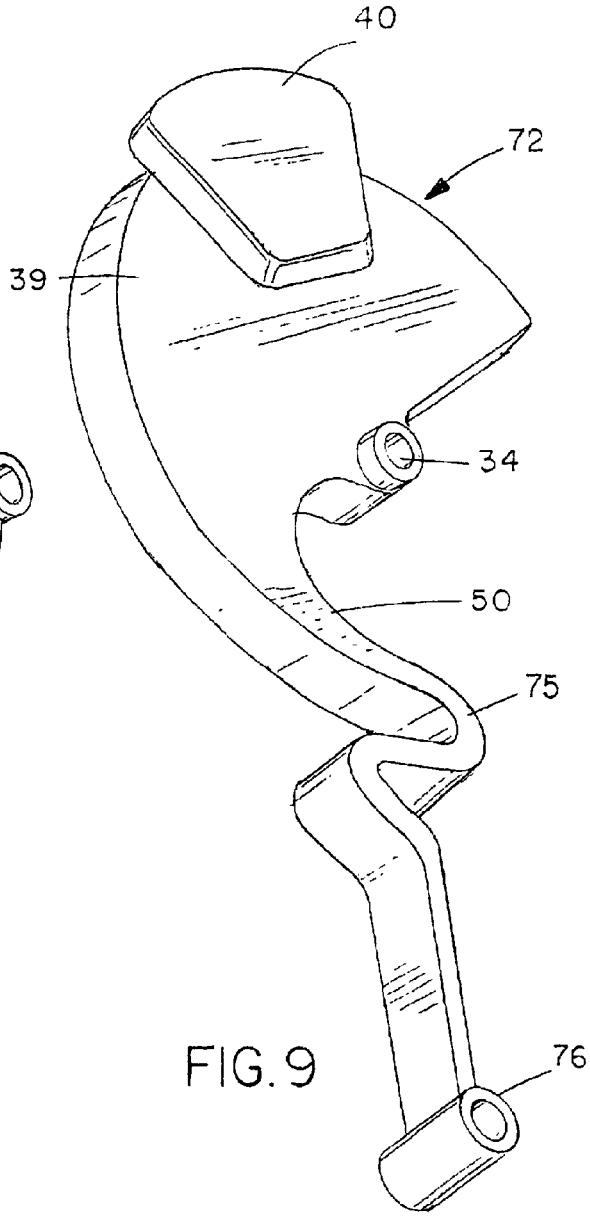
FIG. 9 is a view similar to FIG. 8 showing another modified latch member.

Other shapes of latch member may be used to achieve the required spring and latching actions, and FIGS. 8 and 9 illustrated two possible alternative latch members 70 and 72 which may be mounted in the housing 14 in place of the latch member 28. The upper end portion of latch members 70 and 72 is similar to that of FIGS. 1 to 7, and like reference numerals have been used for like portions as appropriate. However, the straight, inclined spring finger 54 of the previous embodiment is replaced with a round, generally C-shaped spring member 74 in the version of FIG. 8, and a generally S-shaped spring member 75 in the version of FIG. 9. Each of the spring members 74 and 75 has an end stop pin 76 at its free end, which is secured in a hole in one of the housing walls, so that the spring member is deformed and put under tension or compression as the latch member moves into the released position.

In an another alternative, the integral spring finger or member may be eliminated, and a separate spring may then be positioned in the housing to bias the latch member back towards the latched position. However, the integral actuator, latch tab, and spring arrangement illustrated in the drawings considerably reduces the number of separate parts required for the apparatus. Similarly, the two part welded, bonded, or snap engaged housing avoids the need for separate screws or fastener devices. In turn, this reduces expense in manufacture and reduces the risk of parts failing or becoming displaced relative to one another. It also simplifies assembly of the apparatus.

The belt clip apparatus of this invention is of relatively inexpensive and simple design, while providing an extremely secure latching engagement for a portable device such as a cell phone, pager, personal organizer, handheld PC's or the like. This permits a user to carry such a device in a readily accessible position on their clothing, while reducing the risk of the device accidentally being released from the belt clip due to failure of the latch, or accidental actuation of a latch release actuator. The portable device is readily latched in a locked position, simply by inserting the latch pin in the upper end of the slot, and pushing down to rotate the latch member out of the way. Once the latch pin is positioned in the lower end of the slot, the latch member will snap back into the locked position, holding the portable device securely in the belt clip. The actuator of this invention requires a positive, sideways movement rather than a simple push down release, and release of the carried device is much less likely to occur accidentally. The apparatus does not require any screws or bolts to secure two halves of the base housing together. Instead, the front and rear walls of the housing are of molded plastic material and are secured together by adhesive, sonic welding, or an aggressive snap fit.

Although an exemplary embodiment of the invention has been described above by way of example only, it will be understood by those skilled in the field that modifications may be made to the disclosed embodiment without departing from the scope of the invention, which is defined by the appended claims.

We claim:

1. A belt clip apparatus, comprising:

a holder assembly for attachment to a user's apparel in a generally vertical orientation, the holder assembly having a latch opening and having an upper end which faces upwardly when the holder assembly is attached to a users apparel;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator at the upper end of the holder assembly linked to the latch member for moving the latch member between the locked and released positions, the actuator being adapted to be moved in a generally horizontal direction transverse to the hanging direction in order to release the latch member.

2. The apparatus as claimed in claim 1, wherein the holder assembly comprises a first, base member, a second, belt clip member hinged to the first member, and a biasing device for biasing the clip member against the first member so as to hold the belt clip apparatus on a wearer's clothing or belt with the first member on one side and the second member on the other side of the belt or clothing with a portion of the belt or clothing gripped between the first and second members.

3. The apparatus as claimed in claim 1, including a biasing device for biasing the latch member from the released position back towards the locked position.

4. The apparatus as claimed in claim 1, wherein the holder assembly comprises a base member having a front wall in which the latch opening is located, a clip member for securing the base member to a wearer's belt or other clothing, and the latch member is rotatably mounted on the base member for movement between the latched and released positions.

5. The apparatus as claimed in claim 4, wherein the base member comprises a housing having a rear wall spaced from the front wall, and the latch member is rotatably mounted in the housing between the front and rear walls.

6. The apparatus as claimed in claim 5, wherein the housing, latch member and actuator are formed from no more than three separate parts.

7. The apparatus as claimed in claim 1. wherein the holder assembly comprises a base housing having a front wall in which the latch opening is located, and a clip member for securing the base housing to a user's apparel, the housing having an actuator opening, and the latch member is rotatably mounted in the housing, the actuator comprising an integral portion of the latch member projecting out of the actuator opening and movable in the actuator opening between end positions corresponding to the locked and released positions of the latch member.

8. The apparatus as claimed in claim 7, wherein the latch member has a latch tab which projects across the latch opening to lock the lock pin in the latch opening in the locked position and which is retracted away from the latch opening in the released position.

9. The apparatus as claimed in claim 7, wherein the latch member has an integral, generally C-shaped spring finger for biasing the latch member towards the locked position, the spring finger having an end secured to the housing.

10. The apparatus as claimed in claim 7, wherein the latch member has an integral, generally S-shaped spring finger for biasing the latch member towards the locked position, the spring finger having an end secured to the housing.

11. The apparatus as claimed in claim 7,wherein the latch member is rotatably mounted in the housing for rotation about a pivot axis extending transverse to the housing front wall, and the latch opening comprises an elongate slot having opposite ends, the lock pin being located at one end of the slot in the locked position, the latch member having a latch finger projecting transversely across the slot adjacent the lock pin in the locked position.

12. The apparatus as claimed in claim 11, wherein the housing is made in two parts which are secured together with the latch member movably mounted in a cavity formed between said parts, and the two parts of the housing are of a first plastic material, and the latch member is of a second plastic material different from said first material and having a smooth, sliding relationship with said first material.

13. The apparatus as claimed in claim 12, wherein the two parts of the housing are sonically welded together.

14. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator linked to the latch member for moving the latch member between the locked and released positions, the actuator being adapted to be moved in a generally horizontal direction transverse to the hanging direction in order to release the latch member;

the holder assembly comprising a housing having a front wall in which the latch opening is located and a rear wall spaced from the front wall, a clip member for securing the housing to a wearer's belt or other clothing, and the latch member rotatably mounted in the housing between the front and rear wall; and the housing walls are of a first plastic material and the latch member is of a second plastic material different from the first material.

15. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator linked to the latch member for moving the latch member between the locked and released positions, the actuator being adapted to be moved in a generally horizontal direction transverse to the hanging direction in order to release the latch member;

the holder assembly comprising a housing having a front wall in which the latch opening is located and a rear wall spaced from the front wall, a clip member for securing the housing to a wearer's belt or other clothing, and the latch member rotatably mounted in the housing between the front and rear wall;

the housing walls are of a first plastic material and the latch member is of a second plastic material different from the first material; and the latch member is of a self-lubricating plastic material.

16. A belt clip apparatus, comprising:

a holder assembly for attachment to a user's apparel in a generally vertical orientation, the holder assembly having a latch opening an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator linked to the latch member for moving the latch member between the locked and released positions, the actuator being adapted to be moved in a generally horizontal direction transverse to the hanging direction in order to release the latch member;

the holder assembly comprising a housing having a front wall in which the latch opening is located and a rear wall spaced from the front wall, a clip member for securing the housing to a wearer's belt or other clothing, and the latch member rotatably mounted in the housing between the front and rear wall;

the housing walls are of a first plastic material and the latch member is of a second plastic material different from the first material; and the second plastic material has a higher melting point than the first plastic material, and the housing walls are secured together by sonic welding.

17. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator linked to the latch member for moving the latch member between the locked and released positions, the actuator being adapted to be moved in a generally horizontal direction transverse to the hanging direction in order to release the latch member;

the holder assembly comprising a housing having a front wall in which the latch opening is located and a rear wall spaced from the front wall, a clip member for securing the housing to a wearers belt or other clothing, and the latch member rotatably mounted in the housing between the front and rear wall;

the housing walls are of a first plastic material and the latch member is of a second plastic material different from the first material; and the latch opening comprises an elongate opening having a larger first end portion, a smaller second end portion of smaller dimensions than the first end portion, and a longitudinal axis which extends in a generally vertical direction when the apparatus is in use, the lock pin having an enlarged end of smaller dimensions than the first end portion of the opening and of larger dimensions than the second end portion, and being retained in the smaller, second end portion of the latch opening when the latch member is in the first, locked position.

18. The apparatus as claimed in claim 17, wherein the latch member protrudes at least partially across the slot at a location between the first and second end portions in the first, locked position and is retracted away from the slot in the released position.

19. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening; and a manually operable actuator linked to the latch member for moving the latch member between the locked and released positions, the actuator being adapted to be moved in a generally horizontal direction transverse to the hanging direction in order to release the latch member; and a biasing device for biasing the latch member from the released position back towards the locked position;

the biasing device comprising a spring integrally formed with the latch member.

20. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening;

a manually operable actuator linked to the latch member for moving the latch member between the locked and released positions, the actuator being adapted to be moved in a generally horizontal direction transverse to the hanging direction in order to release the latch member;

the holder assembly comprising a base housing having a front wall in which the latch opening is located, and a clip member for securing the base housing to a users apparel, the housing having an actuator opening, and the latch member is rotatably mounted in the housing, the actuator comprising an integral portion of the latch member projecting out of the actuator opening and movable in the actuator opening between end positions corresponding to the locked and released positions of the latch member; and the housing having spaced side walls and end walls, and the latch member includes an integrally formed spring finger projecting from the latch member towards a side wall, the spring finger being compressed against the side wall in the released position of the latch member, whereby the latch member is biased towards the locked position by the compressed spring finger.

21. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening;

a manually operable actuator linked to the latch member for moving the latch member between the locked and released positions, the actuator being adapted to be moved in a generally horizontal direction transverse to the hanging direction in order to release the latch member;

the holder assembly comprising a base housing having a front wall in which the latch opening is located, and a clip member for securing the base housing to a user's apparel, the housing having an actuator opening, and the latch member is rotatably mounted in the housing, the actuator comprising an integral portion of the latch member projecting out of the actuator opening and movable in the actuator opening between end positions corresponding to the locked and released positions of the latch member;

the latch member being rotatably mounted in the housing for rotation about a pivot axis extending transverse to the housing front wall, and the latch opening comprises an elongate slot having opposite ends, the lock pin being located at one end of the slot in the locked position, the latch member having a latch finger projecting transversely across the slot adjacent the lock pin in the locked position; and the latch finger having an arcuate portion engaging around the lock pin in the locked position, the arcuate portion having an angular width of greater than 180°.

22. A belt clip apparatus, comprising:

a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening;

a manually operable actuator linked to the latch member for moving the latch member between the locked and released positions, the actuator being adapted to be moved in a generally horizontal direction transverse to the hanging direction in order to release the latch member;

the holder assembly comprising a base housing having a front wall in which the latch opening is located, and a clip member for securing the base housing to a user's apparel, the housing having an actuator opening, and the latch member is rotatably mounted in the housing, the actuator comprising a portion of the latch member projecting out of the actuator opening and movable in the actuator opening between end positions corresponding to the locked and released positions of the latch member;

the latch member being rotatably mounted in the housing for rotation about a pivot axis extending transverse to the housing front wall, and the latch opening comprises an elongate slot having opposite ends, the lock pin being located at one end of the slot in the locked position, the latch member having a latch finger projecting transversely across the slot adjacent the lock pin in the locked position; and one wall of the housing having an arcuate slot centered on the pivot axis, and the latch finger having a guide pin extending transversely in a direction parallel to the pivot axis and slidably engaging in said arcuate slot for movement between opposite ends of said slot as said latch member moves between the first, locked position and the released position.

23. A belt clip apparatus, comprising a holder assembly for attachment to a user's apparel in a generally vertical orientation, the holder assembly having a latch opening;

an anchor member for securing to a portable device to be suspended vertically from the holder assembly, the anchor member having a lock pin for engagement in the latch opening;

a latch member in the holder assembly movable between a first, latched position locking the lock pin in the latch opening, and a released position permitting the lock pin to be removed from the latch opening;

a manually operable actuator linked to the latch member for moving the latch member between the locked and released positions, the actuator being adapted to be moved in a generally horizontal direction transverse to the hanging direction in order to release the latch member;

the holder assembly comprising a base housing having a front wall in which the latch opening is located, and a clip member from securing the base housing to a user's approval, the housing having an actuator opening, and the latch member is rotatably mounted in the housing, the actuator comprising a portion of the latch member projecting out of the actuator opening and movable in the actuator opening between end positions corresponding to the locked and released positions of the latch member; and the latch member having an integral, elongate spring finger engaging a portion of the housing to bias the latch member towards the locked position when the latch member is located in the released position.

24. A belt clip apparatus, comprising:

a base housing having a front wall with an elongate latch opening for receiving a lock pin projecting from an object to be releasably secured to the base housing, the latch opening having a first end of predetermined dimensions and a second end of dimensions smaller than said first end;

a clip device for releasably securing the base housing to a wearer's apparel with the front wall facing outwardly and the latch opening oriented generally vertically;

a latch member movably mounted in the housing for movement between a first, latched position and a second, released position, the latch member having a latching tab which protrudes at least partially across the latch opening in the latched position at a location between the smaller second end and larger first end, so as to lock the lock pin in the smaller second end, the latching tab being retracted away from the latch opening in the released position;

an actuator linked to the latch member for moving the latch member between the first and second positions, the actuator being movable in a direction generally transverse to the longitudinal axis of the latch opening; and the housing having an upper end, a lower end, and opposite sides, the upper end of the housing having a cut-out region with opposite end walls, and a portion of the latch member projecting out of the cut-out region, the projecting portion comprising said actuator and being movable by a user back and forth between the opposite end walls in order to move the latch member between the first and second positions.

25. The apparatus as claimed in claim 24, wherein the latch member is rotatably mounted in the housing for rotation about a pivot axis transverse to the front wall of the housing, the pivot axis being located adjacent the larger end of the latch opening, the latch member having a part circular first end portion centered on said pivot axis, the projecting portion comprising a thickened end region of said part circular portion, and an arcuate indent extending from said first end portion to said latching tab.

26. The apparatus as claimed in claim 25, wherein said latch member has an integral spring finger extending from the opposite side of said latching tab to said first end portion for engaging a portion of the housing to bias the latch member towards the locked position when the latch member is in said released position.

* * * * *